US012383015B2

(12) United States Patent
Busch

(10) Patent No.: US 12,383,015 B2
(45) Date of Patent: Aug. 12, 2025

(54) EYE PROTECTION, EYE PROTECTION DEVICE FOR A HEADGEAR AND HEADGEAR COMPRISING AN EYE PROTECTION DEVICE

(71) Applicant: Busch PROtective Germany GmbH & Co. KG, Guetersloh (DE)

(72) Inventor: Edwin Busch, Guetersloh (DE)

(73) Assignee: Busch PROtective Germany GmbH & Co KG, Guetersloh (DE)

( * ) Notice: Subject to any disclaimer, the term of this patent is extended or adjusted under 35 U.S.C. 154(b) by 216 days.

(21) Appl. No.: 17/752,197

(22) Filed: May 24, 2022

(65) Prior Publication Data

US 2023/0255299 A1 Aug. 17, 2023

(30) Foreign Application Priority Data

Feb. 14, 2022 (DE) ..... 10 2022 103 441.0

(51) Int. Cl.
*A42B 3/18* (2006.01)
*A42B 3/28* (2006.01)

(52) U.S. Cl.
CPC ..... *A42B 3/185* (2013.01); *A42B 3/28* (2013.01); *A44D 2203/00* (2013.01)

(58) Field of Classification Search
CPC .. A42B 3/18; A42B 3/185; A42B 3/20; A42B 3/22; A42B 3/221; A42B 3/222; A42B 3/24; A42B 3/28; A44D 2203/00
See application file for complete search history.

(56) References Cited

U.S. PATENT DOCUMENTS 2,026,741 A * 1/1936 Kintz ..... A61F 9/029 2/10
4,884,302 A * 12/1989 Foehl ..... A42B 3/222 2/427
5,555,570 A * 9/1996 Bay, Jr. ..... A42B 3/185 2/424
5,991,930 A * 11/1999 Sorrentino ..... A42B 3/22 2/424
6,119,276 A * 9/2000 Newcomb ..... A42B 3/24 2/436
8,225,431 B2 * 7/2012 Cyr ..... A42B 3/22 2/6.3
8,677,517 B1 * 3/2014 Morency ..... A42B 3/221 2/424

(Continued)

FOREIGN PATENT DOCUMENTS

DE 20 2020 101 957 U1 6/2020
EP 1 124 152 A1 8/2001
EP 2 273 898 B1 1/2015

*Primary Examiner* — F Griffin Hall
(74) *Attorney, Agent, or Firm* — Scully, Scott, Murphy & Presser, P.C.

(57) ABSTRACT

An eye protection device including: a viewing material; and a frame connected to the viewing material. Wherein the frame includes at least one contact body projecting from the frame, the at least one contact body having at least one contact surface, the at least one contact surface being configured to project from the frame at an angle of 30° to 150° relative to a surface of the viewing material, wherein the at least one contact body comprises at least one frame magnet integrated into the at least one contact body and configured to magnetically couple with a headgear.

20 Claims, 3 Drawing Sheets

(56) References Cited

U.S. PATENT DOCUMENTS

| | | | | |
|---|---|---|---|---|
| 9,096,148 | B2 * | 8/2015 | Fiedler | B60N 3/046 |
| 9,125,447 | B2 * | 9/2015 | Lebel | A44B 17/0076 |
| 9,439,470 | B2 * | 9/2016 | McGinn | F41H 11/04 |
| 10,188,167 | B2 * | 1/2019 | Kass | A42B 3/163 |
| 10,757,995 | B2 * | 9/2020 | Jacobsen | A42B 3/063 |
| 10,791,784 | B2 * | 10/2020 | Kang | A42B 3/185 |
| 11,019,872 | B2 * | 6/2021 | Calilung | A42B 3/0493 |
| 11,129,431 | B2 * | 9/2021 | Whitesell | A42B 3/185 |
| 2007/0033775 | A1 * | 2/2007 | Hsiao | G02C 3/02 24/303 |
| 2010/0064405 | A1 * | 3/2010 | McGovern | A42B 3/225 2/424 |
| 2014/0173811 | A1 * | 6/2014 | Finiel | A42B 3/04 2/422 |
| 2018/0295925 | A1 | 10/2018 | Gagliardo et al. | |
| 2019/0029356 | A1 * | 1/2019 | Michel | A42B 3/24 |
| 2019/0365009 | A1 * | 12/2019 | Frieder, III | A42B 3/185 |
| 2022/0053870 | A1 * | 2/2022 | Santiago | A42B 7/00 |
| 2023/0136136 | A1 * | 5/2023 | Deheselle | A42B 3/223 2/424 |
| 2023/0137423 | A1 * | 5/2023 | Guglielmo | A42B 3/185 2/9 |

* cited by examiner

EYE PROTECTION, EYE PROTECTION DEVICE FOR A HEADGEAR AND HEADGEAR COMPRISING AN EYE PROTECTION DEVICE

CROSS-REFERENCE TO RELATED APPLICATION

The present application is based upon and claims the benefit of priority from DE 10 2022 103 441.0 filed on Feb. 14, 2022, the entire contents of which is incorporated herein by reference.

BACKGROUND

Field

The present disclosure relates to eye protection for fixing to a headgear.

In addition, the present disclosure relates to an eye protection device for a headgear and a headgear comprising an eye protection device.

Prior Art

Protecting the eyes is very important for a whole range of professions and activities, for example for police officers, firefighters, rescue workers and soldiers as well as, for example, when skiing and cycling. Various types of goggles, visors and face protection devices exist, which protect the user's eyes as eye protection.

Different situations require the user to put on or remove the eye protection, for example in changing lighting conditions or when hazardous situations occur. This must be done quickly, especially in dangerous situations, as every second can count for police officers, firefighters or soldiers, for example.

In the case of many of these professions and activities, the user wears headgear such as, by way of example, protective helmets at the same time. Admittedly, it is frequently difficult for the user to put on eye protection if the latter is already wearing headgear, since the side surfaces, for example, of a helmet can block the sidepieces of the safety goggles. As a result, putting on and taking off the eye protection takes longer or is completely prevented, which is undesirable especially in hazardous situations.

SUMMARY

An object is to provide eye protection, an eye protection device and headgear having an eye protection device, which fixes the eye protection in a stable and secure manner to the headgear and makes it easier for a wearer of the headgear to put on and take off the eye protection.

Such object can be achieved by eye protection for fixing to a headgear, comprising a viewing area and a frame which is connected to the viewing area, wherein the frame comprises at least one contact body projecting from the viewing area, which contact body has a first contact surface which is configured as at least one surface projecting from the eye protection at an angle, such as 30° to 150°, to the viewing area, wherein the contact body comprises at least one frame magnet which is integrated into the contact body.

The eye protection can make it possible for it to be put on and taken off easily and quickly. To this end, the eye protection can be fixed by at least one frame magnet to the headgear. Since the frame magnet can be integrated in the contact body projecting from the viewing area, the eye protection can be quickly and easily fixed to different headgear.

The contact surface can be arranged at an angle of 30° to 150° to the viewing area. The contact surface can project at an angle of 30° to 120°, such as substantially 90°, to the viewing area of the eye protection. An angle of substantially 90° means that the contact surface projects substantially horizontally from the eye protection. If the viewing area is curved, an average of the tangents of the viewing area can be assumed to be the orientation of the viewing area, to which the angle of the contact surface is measured.

The eye protection can be a visor, goggles, a mask or a face shield. For example, the eye protection can be a protective visor or sealed goggles, e.g., safety goggles or skiing goggles. The eye protection can extend vertically.

The frame can be firmly connected to the eye protection or a component of the eye protection. The frame can comprise an additional magnet which can be arranged in the horizontal direction and/or the vertical direction centrally on the frame. By means of the additional magnet, the eye protection can be fixed to a retainer provided for this purpose, while the eye protection is not needed. To this end, the retainer can comprise a retaining magnet. For example, the retainer can be fastened to a garment, e.g., a vest.

The frame can comprise at least one protrusion projecting, from the viewing area, such as horizontally from the viewing area. The eye protection can be fixed in a more stable manner to the headgear by the protrusion. The protrusion can be arranged vertically offset above or below the contact body. The protrusion can project rearward or forward from the viewing area. A cross-section of the protrusion can be trapeze-shaped.

According to one embodiment, the frame can comprise two goggles sidepieces, wherein the goggles sidepieces can be fixed in a detachable manner to the frame. This makes the eye protection even more versatile.

The at least one frame magnet can be integrated into an upper side or an underside of the contact body. The frame magnet can be integrated in a planar manner into the first contact surface. In other words, the frame magnet can align with the first contact surface. According to one embodiment, the at least one frame magnet can be arranged below or above the first contact surface. The at least one frame magnet can have a cylindrical configuration. The poles of the at least one frame magnet can point in the vertical direction.

The at least one frame magnet can comprise a first frame magnet and a second frame magnet. In this way, the eye protection can be securely fixed to the headgear. The first frame magnet can be arranged horizontally offset to the second frame magnet in the contact body. The first frame magnet and the second frame magnet can be integrated into separate contact bodies or separate portions of the contact body. A polarity of the first frame magnet can be opposite to a polarity of the second frame magnet. The first frame magnet can be arranged at a right end and the second frame magnet can be arranged at a left end of the frame.

The contact body can comprise at least two separately configured portions or of a single, contiguous portion. At least one of the frame magnets can be centrally arranged in at least one of the portions. The contact body can comprise two round circular portions, in each of which one of the frame magnets can be arranged.

The contact body can comprise a first prefixing magnet arranged in the horizontal direction centrally on the frame. The first frame magnet can be arranged horizontally offset on a first side and the second frame magnet can be arranged horizontally offset on an opposite second side of the first prefixing magnet. The first prefixing magnet can be integrated into a portion of the contact body, from which holding teeth can protrude.

The first contact surface can be configured as a horizontally extending flat surface. The first contact surface can project horizontally from a back of the viewing area. The first contact area can comprise a latch element protruding vertically from the first contact surface. The latch element can prevent unintentional detachment of the eye protection device. A shape of the first contact surface of the contact body can be adapted to a second contact surface of a fastening device which can be configured to be fixed to headgear.

According to one embodiment, the eye protection can be configured as a complete face shield which, in addition to the eyes, can be configured to also cover the nose and mouth of a user, wherein the eye protection can comprise an air supply device for supplying fresh air to an internal space of the face shield.

Consequently, the face shield can not only protect the eyes, but can also protect the remaining parts of the user's face. The face shield can be sealed in an airtight manner, such as by a seal. Thanks to the air supply device, the face shield can be utilized as simple respiratory protection. If the face shield is no longer needed as respiratory protection, it can be easily detached from the headgear by removing it from the fastening device.

According to one embodiment, the eye protection can comprise at least one ventilation slit on an upper side of the eye protection, wherein the eye protection can be configured as goggles.

Thanks to the ventilation slit, an air exchange of the internal space of the eye protection can be achieved, even if the eye protection is otherwise sealed against the face of the user. In this way, fogging of the eye protection, for example, can be prevented. For example, the eye protection can be configured as skiing goggles in this embodiment.

The eye protection can comprise a seal for sealing an internal space of the eye protection, wherein the seal can comprise a sealing foam and/or a sealing lip.

The seal can be provided if the internal space of the eye protection and, therefore, the eyes of the user are to be protected, for example, from gases, wind or cold. In addition to eye protection configured as a complete face shield, skiing goggles and similar goggles, for example, also can comprise such seals. The seal can protrude, starting from the eye protection, in the direction of a user's face. The seal can be configured to lie in contact with the user's face if the eye protection is completely fixed to headgear and the user is wearing the headgear.

Such object can also be achieved by an eye protection device for a headgear, comprising eye protection according to any one of the aforementioned embodiments and a separate fastening device, wherein the fastening device comprises at least one fixing portion for fixing the fastening device to an underside of the headgear or is integrally configured with the headgear on the underside of the headgear, wherein the fastening device comprises at least one holding magnet, wherein the first contact surface is configured in a form fitted manner or with a complementary shape to a second contact surface of the fastening device, wherein, in a completely fixed state of the eye protection device, the first contact surface lies in contact with the second contact surface and the at least one holding magnet magnetically couples with the at least one frame magnet and magnetically fixes the frame.

The eye protection device can embody the same advantages, features and properties as the eye protection described above.

The eye protection device can provide an easy-to-use and quick possible way of putting on and taking off the eye protection. The fastening device can be fixed by the fixing portion to the underside of the headgear before the headgear is put on. The eye protection can subsequently be magnetically fixed to the fastening device and, therefore, to the headgear in a stable, secure and detachable manner by means of the frame.

The terms up, down, horizontally, vertically, vertical line and other details regarding the arrangement and orientation of the eye protection, the eye protection device and/or the headgear refer to the state when the eye protection and/or the eye protection device is/are completely fixed to the headgear, a person is wearing the headgear on his head and is holding his head upright and straight.

In a separated state of the eye protection device, the frame is not fixed to the fastening device. None of the frame magnets is magnetically coupled to a holding magnet. In this state, the viewing area is not positioned in front of the eyes of a user. In the completely fixed state, the frame having the eye protection is fastened, by way of contrast, to the fastening device and, therefore, to the helmet. All frame magnets are magnetically coupled with at least one of the holding magnets. In this state, the viewing area is arranged in front of the user's eyes.

In the context of this description, magnetic coupling is understood to mean that magnets magnetically coupled to one another are arranged with respect to one another such that there is an attractive magnetic force effect between them. The magnetic force effect is sufficient to fix the eye protection having the frame to the fastening device. However, this does not necessarily mean that these magnets also touch each other. By way of contrast, the term "lie in contact with" does mean that objects lying in contact with one another are touching.

The eye protection device can be configured in two parts, wherein a first part comprises the eye protection having the frame and a second part comprises the fastening device.

The contact surfaces can be portions of the eye protection device, on which, in the completely fixed state, the contact body of the frame lies in contact with the fastening device. The second contact surface can be configured in the completely fixed state as a flat surface extending at an angle of substantially 30° to 150°, such as substantially 60° to 120°, or substantially 90°, to the viewing area of the eye protection. The angle enclosed by the second contact surface with the viewing area can be equal to the angle enclosed by the first contact surface with the viewing area.

The holding magnet can be integrated in a planar manner into the second contact surface. In other words, the holding magnet can align with the second contact surface. The poles of the holding magnet can point in the vertical direction. The frame magnet and the holding magnet can have the same polarity. In other words, in the case of both magnets, the same pole can point in the same direction, that is to say, for example, the north pole points upward. In the completely fixed state, the frame magnet can lie in contact with the holding magnet and/or can be, in the completely fixed state, in a magnetic operative connection with the holding magnet.

The headgear can be a helmet, such as a protective helmet, a cap or a hat. According to one embodiment, the fastening device can be configured to be fixed to an underside of a shell of a helmet, such as a protective helmet. According to another embodiment, the fastening device can be configured to be sewn into the headgear. This can have particular utility, for example, in the case of hats or caps.

The fixing portion can comprise a clamping device, a screw device, a magnetic fixing device and/or the fixing portion is a portion of the fastening device, which can be configured as an adhesive surface.

The fastening device can be a component of the headgear and/or the headgear can comprise the fastening device and/or the fastening device can be fixed to the headgear. The fastening device can be configured to be fixed to different circumferential positions of the underside of the headgear. In this way, in addition to the eye protection, neck protection, for example, can also be fixed to the headgear by means of the fastening device.

The at least one frame magnet can comprise the first frame magnet and the second frame magnet, wherein the at least one holding magnet can comprise a first holding magnet and a second holding magnet, wherein, in the completely fixed state, the first holding magnet magnetically couples with the first frame magnet and the second holding magnet magnetically couples with the second frame magnet and magnetically fix the frame.

In this way, the frame can be fixed to two different points of the fastening device. That is to say, the fastening can be realized via two separate pairs of magnets, which prevents unintentional tilting or pivoting of the eye protection. The first frame magnet and the first holding magnet can form the first pair of magnets, and the second frame magnet and the second holding magnet can form the second pair of magnets. The first holding magnet can be arranged horizontally offset to the second holding magnet in the fastening device.

The polarity of the first frame magnet can be inverse to the polarity of the second frame magnet and a polarity of the first holding magnet can be inverse to a polarity of the second holding magnet.

In this way, the eye protection can be prevented from being fixed the wrong way around to the fastening device. If, by way of example, an attempt is made to magnetically couple the second holding magnet to the first frame magnet, they repel one another due to their respective polarities instead of attracting one another.

According to one embodiment, the frame can be fixed to the fastening device in a first semi-fixed state in that the first holding magnet is exclusively magnetically coupled with the first frame magnet or the second holding magnet is exclusively magnetically coupled with the second frame magnet, wherein the frame can be pivoted, in the first semi-fixed state, about a vertical swiveling axis which runs through the magnets magnetically coupling with one another.

In this first semi-fixed state, the eye protection can be consequently only fixed on one side to the fastening device and can be pivoted about the vertical swiveling axis. This makes it possible to either pivot the eye protection such that the other pair of magnets is also magnetically coupled and, consequently, the eye protection device is completely fixed, or to pivot the eye protection so that the viewing area is no longer in the user's line of sight. The first frame magnet and the first holding magnet can be arranged on a right side of the eye protection device and the second frame magnet and the second holding magnet can be arranged on a left side of the eye protection device. Each of the pairs of magnets can be clicked in separately in order to transfer the eye protection device into the first semi-fixed state. The holding magnets can have a cylindrical configuration.

According to a further embodiment, the frame can be fixed in a second semi-fixed state to the fastening device in that the first prefixing magnet arranged in the horizontal direction centrally on the frame magnetically prefixes a second prefixing magnet arranged in the horizontal direction centrally on the fastening device, wherein in the second semi-fixed state, the first contact surface can be pivoted with respect to the second contact surface about a horizontal swiveling axis and the at least one frame magnet does not magnetically couple with the at least one holding magnet.

In the second semi-fixed state, the eye protection can be pivoted in relation to the fastening device as well, but not about a vertical axis, but rather about a horizontal axis. In the context of this description, prefixed means that the prefixing magnets are indeed arranged with respect to one another such that the eye protection is held on the fastening device by the magnetic pull of said prefixing magnets, but the prefixing magnets do not lie in contact with one another along their entire surface. The prefixing magnets can be arranged tilted with respect to one another in the second semi-fixed state. The horizontal axis can run between the prefixing magnets. The holding teeth of that portion of the contact body, in which the first prefixing magnet is integrated, can engage in assigned recesses of the fastening device in the completely fixed state. Two walls can project vertically from the fastening device, such as downward, which enclose a gap which is formed in a form fitted manner or with a complementary shape to the portion of the contact body, in which the first prefixing magnet is integrated.

The eye protection device can comprise a latching mechanism which can hold the eye protection device in the second semi-fixed state. A latching effect of the latching mechanism can be stronger than a magnetic force effect between the first prefixing magnet and the second prefixing magnet in the second semi-fixed state. In order to transfer the eye protection device from the second semi-fixed state into the completely fixed state, the eye protection can be manually flipped about the horizontal swiveling axis. According to one embodiment, the latching mechanism can comprise the holding teeth on the eye protection and the assigned recesses on the fastening device. The holding teeth can be configured form fitting to the assigned recesses. In the semi-fixed state, the holding teeth can lie in contact with the assigned recesses, but are not yet completely arranged in these, while the holding teeth in the completely fixed state can catch in the assigned recesses. The force needed to move the holding teeth into the assigned recesses can be the basis for the latching effect.

The fastening device can comprise a rail extending in the horizontal direction, wherein the at least one holding magnet can be integrated into the rail and wherein the second contact surface can be a portion of the rail.

On the one hand, the fastening device can be easily fixed to the headgear by the rail; on the other hand, the second contact surface for fixing the frame can be provided with the same component. In this way, a compact construction can be achieved. The second contact surface can be a portion of an underside or upper side of the rail.

The rail can have a curved configuration, wherein a curvature of the rail can be configured to correspond to a curvature of the underside of the headgear.

Due to the curvature, the fastening device can be easily fixed to headgear since, as a rule, headgear corresponds to the shape of a head and therefore has a circular or oval shape of the underside. Additionally, or alternatively, the rail can have an elastic configuration. Due to the elastic configuration, the fastening device can be fixed to the underside of headgear of different sizes by adapting the curvature of the rail to the curvature of the underside of the headgear.

The at least one fixing portion can comprise at least one holding surface projecting vertically from the fastening device, which can be configured to lie in contact with an inside of the headgear.

The fastening device can be easily fixed to the headgear, for example glued in, screwed in or sewn in, by the holding surfaces. If the rail has an elastic configuration, the fastening device can, in addition, be held on the headgear by a force exerted by deformation. The holding surface can project vertically upward from the fastening device, such as from the rail. The holding surface can engage in an inside of the headgear. According to one embodiment, the fixing portion can comprise at least three holding surfaces.

The frame can comprise the at least one protrusion protruding, such as horizontally, from the viewing area, wherein, in the completely fixed state, the protrusion can be arranged in a recess of the fastening device, wherein the protrusion can be configured in a form fitted manner or with a complementary shape to the recess.

The protrusion can catch, in the completely fixed state, in the recess and, in this way, can secure the frame against slipping in relation to the fastening device. In the completely fixed state, the protrusion can be completely or partially arranged in the recess. In the completely fixed state, play can remain between an outer end of the protrusion and the recess. The play can ensure that a holding position is predefined in the completely fixed state by the magnets and not by the protrusion, so that the eye protection can be held securely in the completely fixed state. The recess can be introduced into the rail, wherein the recess can extend from the upper side of the rail vertically downward to a position between the upper side and underside of the rail. In other words, in the completely fixed state, the protrusion can rest on a part of the rail. The frame can be moved in the horizontal direction toward the fastening device in order to completely and/or semi fix the frame to the fastening device.

The frame can comprise the latch element protruding vertically from the first contact surface, which can lie in contact with a rear wall of the fastening device in the completely fixed state.

The latch element can prevent the frame from detaching unintentionally from the fastening device in the horizontal direction. This In the case of an eye protection device having a horizontal swiveling axis since, the frame can be detached from the fastening device by pivoting about the horizontal swiveling axis, but not by purely being removed horizontally.

According to one embodiment, the fastening device can comprise two goggles sidepieces, wherein the goggles sidepieces can be fixed in a detachable manner to a main body, such as the rail, of the fastening device.

Thanks to the goggles sidepieces, the eye protection device can also be utilized without headgear. In this case, the eye protection device can be worn like goggles by fixing the googles sidepieces to the fastening device or the frame, and can lie in contact therewith behind the user's ears. If, by contrast, the eye protection device is worn with the headgear, the goggles sidepieces can be removed beforehand.

The fastening device can have an interchangeable form, so that it can be exchanged for another fastening device. The other fastening device can be configured to be fixed to an underside of differently formed headgear. In this way, the eye protection device can be adapted to different headgear.

Such object can also be achieved by headgear, comprising an eye protection device according to any one of the aforementioned embodiments, wherein the fastening device of the eye protection device can be fixed to an underside of the headgear, wherein the headgear can be a helmet, such as a protective helmet.

The headgear can embody the same advantages, features and properties as the eye protection described above and the eye protection device described above.

According to one embodiment, the fastening device of the eye protection device can be detachably fixed, such as screwed down, clamped, inserted or fastened by a hook and loop fastener, to the underside of the headgear. According to another embodiment, the fastening device can be firmly fixed to the underside of the headgear, such as firmly stuck or stitched down. According to a further embodiment, the fastening device can be integrally configured with the headgear. The fastening device can comprise hooks which project such as from an upper side of the fastening device. The hooks can be permanently introduced into the headgear during a manufacturing process of the headgear. For example, in the case of helmets manufactured from foam, e.g., bicycle helmets, the hooks can also be foamed into the underside of the helmet. In this way, a secure fixing of the fastening device to the headgear can be achieved.

BRIEF DESCRIPTION OF THE DRAWINGS

Further features of the invention will become evident from the description of embodiments, together with the claims and the appended drawings. Embodiments can fulfil individual features or a combination of multiple features.

The embodiments are described below without limiting the general concept of the invention by means of exemplary embodiments with reference to the drawings, wherein reference is expressly made to the drawings regarding all of the details which are not explained in greater detail in the text, wherein.

In the drawings, the same or similar elements and/or parts are, in each case, provided with the same reference numerals such that they are not introduced again in each case.

DETAILED DESCRIPTION

Figure 1:
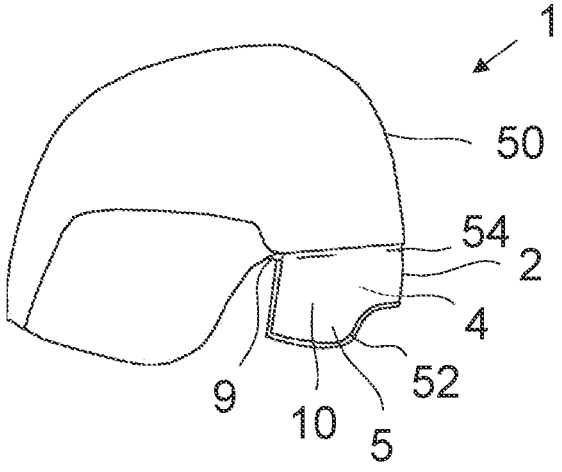
FIG. 1 illustrates a schematically simplified side view of a helmet having safety goggles.

FIG. 1 shows an exemplary embodiment of headgear 1 which is configured in the example shown as a helmet. The helmet comprises a helmet shell 50, to the underside 9 of which an eye protection device 2 is fixed. The eye protection device 2 comprises eye protection 4 which is configured in the embodiment shown as goggles 10. The goggles 10 comprise a viewing area 5 (viewing material, such as an optically transparent material), ventilation slits 54 and a seal 52, so that ventilation is achieved despite a sealing of an internal space of the goggles 10. The goggles 10 are, for example, skiing goggles.

Figure 2:
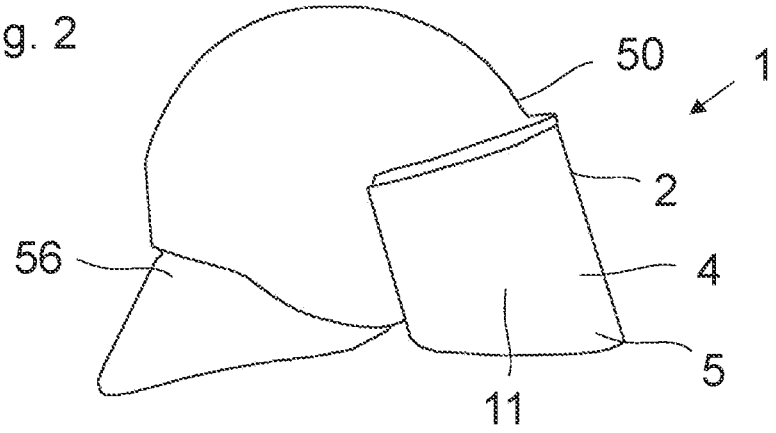
FIG. 2 illustrates a schematically simplified side view of a protective helmet having a visor and neck protection.

FIG. 2 shows another exemplary embodiment of headgear 1 which is a protective helmet, as used, for example, by police officers. An eye protection device 2 having eye protection 4 in the form of a visor 11 is fixed to the underside 9 of the helmet shell 50. Neck protection 56 is, in addition, fixed to the back of the helmet, which neck protection is fixed, for example, in a detachable manner with a fastening device, with which the eye protection 4 can also be fixed to the headgear 1.

Figure 3:
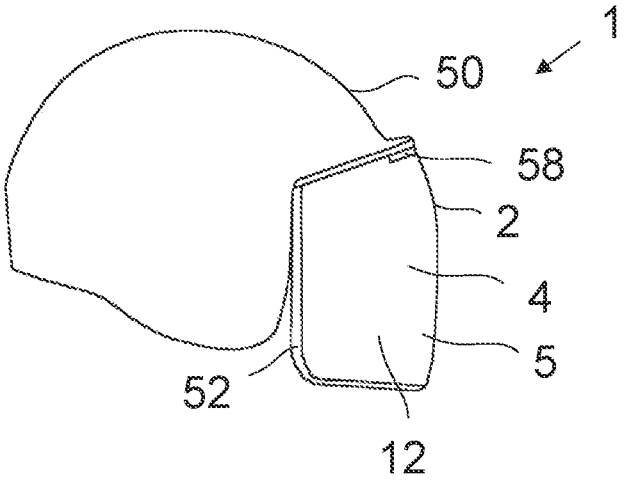
FIG. 3 illustrates a schematically simplified side view of a helmet having a face shield.

A third example of headgear 1 is shown in FIG. 3. This headgear 1 is a helmet, to which a face shield 12 is fixed as eye protection 4 by means of the eye protection device 2. In addition to a seal 52, which seals an internal space of the face shield 12 in an airtight manner when it is worn, the face shield 12 comprises an air supply device 58 which supplies the user with fresh air. In this way, the helmet can be used as simple respiratory protection.

In addition to helmets, the eye protection device 2 can also be fixed to caps or hats, for example, by sewing it into the caps and hats.

Figure 4:
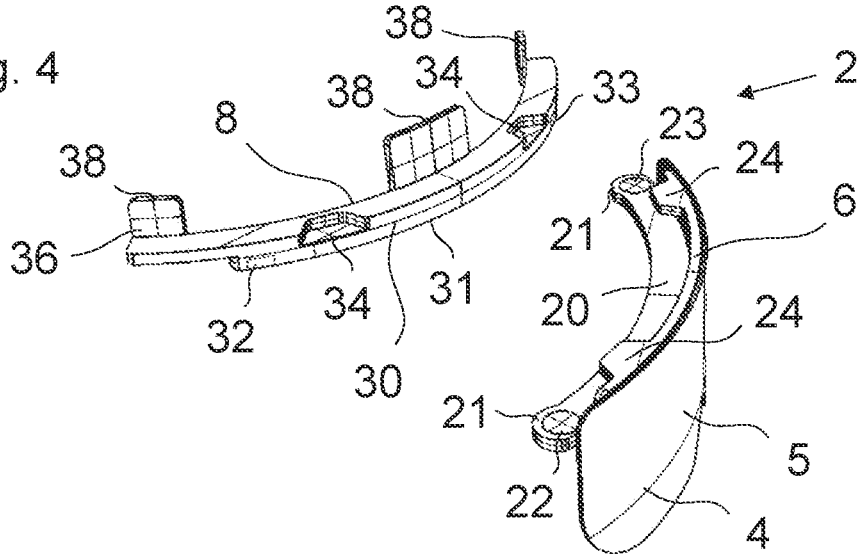
FIG. 4 illustrates a schematically simplified perspective representation of a first embodiment of an eye protection device in the separated state.

FIG. 4 schematically shows, in a simplified manner, an exemplary first embodiment of an eye protection device 2, with which, for example, the eye protection 4 from FIGS. 1 to 3 is fixed to the headgear 1. The eye protection device 2 comprises the eye protection 4 and a fastening device 8 configured separately to the eye protection 4. The eye protection 4 comprises the viewing area 5 and a frame 6 which is firmly connected to the eye protection 4. It is not necessary for the frame 4 to completely surround an outer edge of the viewing area 5, as is occasionally the case with goggles. Instead, the viewing area 5 is largely freestanding in the exemplary embodiment shown. The frame 6 comprises a contact body 20 projecting horizontally from the viewing area 5, which contact body has a first, horizontally extending contact area 21. According to other embodiments, the contact surface 21 can also be oblique. At the lateral ends of the contact body 20, two circular portions are configured, into which a first frame magnet 22 and a second frame magnet 23 are integrated centrally. A part of the frame 6 is configured as two trapeze-shaped protrusions 24 vertically offset above the contact body 20.

The fastening device 8 is configured to be fixed to the headgear 1 and provides a fixing portion 36 for this purpose. In the embodiment shown, the fixing portion 36 is configured as three holding surfaces 38 which protrude vertically upward from a rail 30 of the fastening device 8. The fastening device 8 is fixed to a helmet by means of the holding surfaces 38 and the rail 30, for example, in such a way that an upper side of the rail 30 lies in contact with a lower edge of the helmet shell 50 and the holding surfaces 38 engage in an inside of the helmet. In this state, the fastening device 8 is, for example, screwed on, glued on, sewn on, clamped or otherwise fixed to the helmet. For clamping purposes, the rail 30 can, for example, have an elastic configuration so that it presses with the holding surfaces 38 against the inside of the helmet. In order to follow the circumference of the underside of the headgear 1, the rail 30 has in addition a curved configuration.

A first holding magnet 32 and a second holding magnet 33 are integrated into the rail 30. Since the holding magnets 32, 33 are not visible in the selected view, the position of the holding magnets 32, 33 is merely indicated as a dashed line. In addition, the rail 30 comprises two recesses 34 which are introduced into the upper side of the rail 30 and extend approximately up to half the height of the rail 30. The recesses 34 are configured in a form fitted manner or with a complementary shape to the protrusions 24. In the separated state of the eye protection device 2 shown in FIG. 4, the frame 6 does not lie in contact with the fastening device 8.

Figure 5:
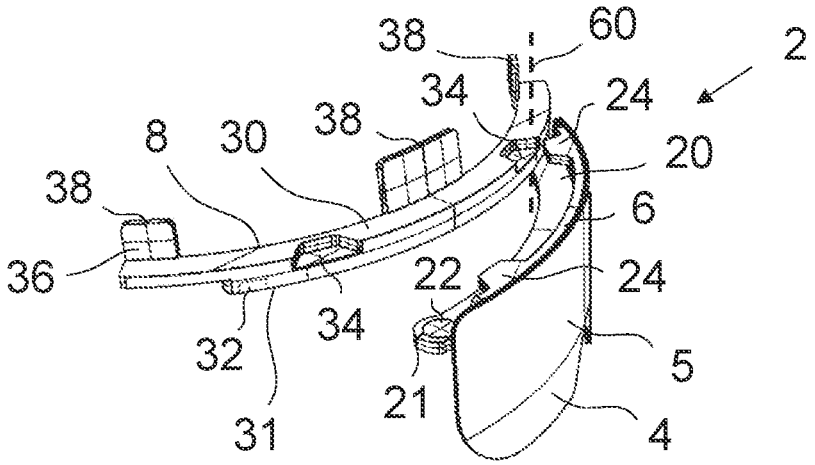
FIG. 5 illustrates a schematically simplified perspective representation of the eye protection device from FIG. 4 in the first semi-fixed state.

FIG. 5 shows a first semi-fixed state of the eye protection device 2 from FIG. 4. In this first semi-fixed state, the portion of the first contact surface 21, in which the second frame magnet 23 is integrated, lies in contact with a second contact surface 31 of the rail 30 from below, so that the second frame magnet 23 is arranged below the second holding magnet 33 and these magnetically attract one another or respectively are magnetically coupled with one another. By way of contrast, the first frame magnet 22 is not magnetically coupled with the first holding magnet 32.

As an alternative to the state shown in FIG. 5, in the first semi-fixed state, the first frame magnet 22 can also magnetically couple with the first holding magnet 32, while the second frame magnet 23 does not magnetically couple with the second holding magnet 33. In any case, the eye protection 4 can be pivoted, in the first semi-fixed state, about a vertical axis 60. This makes it possible to quickly and easily flip up the viewing area 5 or to flip it down, depending on whether the eye protection 4 is needed.

Figure 6:
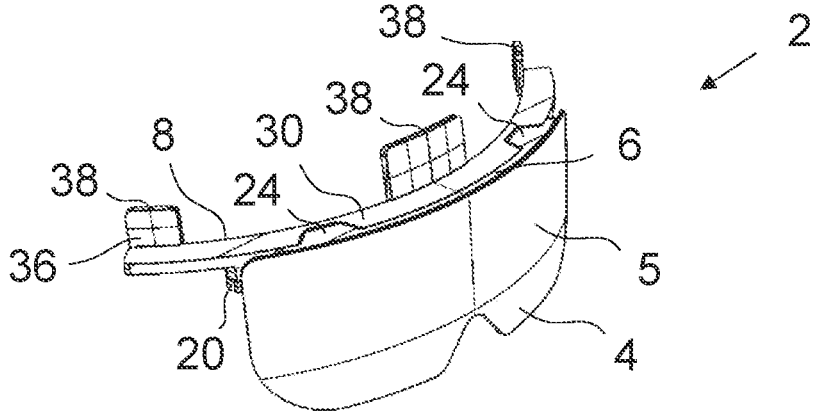
FIG. 6 illustrates a schematically simplified perspective representation of the eye protection device from FIGS. 4 and 5 in the completely fixed state.

In the completely fixed state shown in FIG. 6, both the first pair of magnets, that is to say the first frame magnet 22 and the first holding magnet 32, as well as the second pair of magnets, that is to say the second frame magnet 23 and the second holding magnet 33, each magnetically couple with one another. At the same time, the protrusions 24 are arranged in the recesses 34 which are form fitted or complementary shaped. In this way, the protrusions 24 secure the eye protection 4 on the fastening device 8. In this completely fixed state, the eye protection 4 is held securely on the fastening device 8 and, therefore, on the headgear 1.

Figure 7:
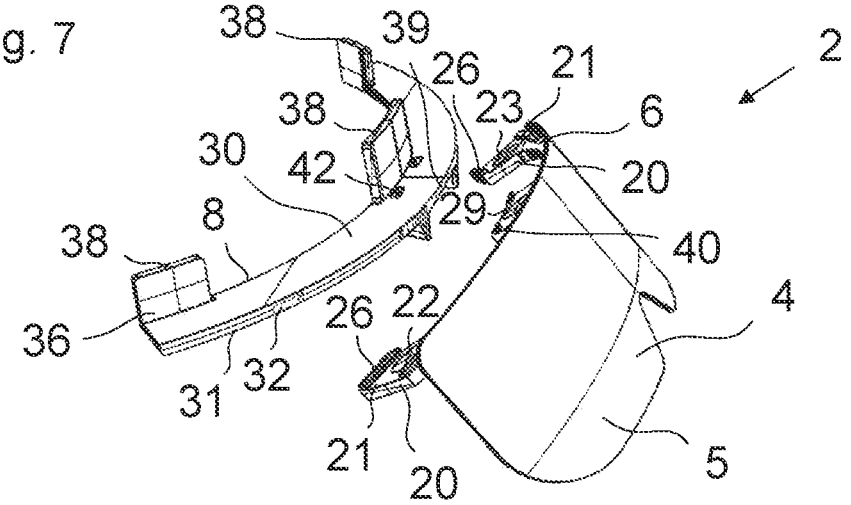
FIG. 7 illustrates a schematically simplified perspective representation of a second embodiment of an eye protection device in the separated state.
Figure 8:
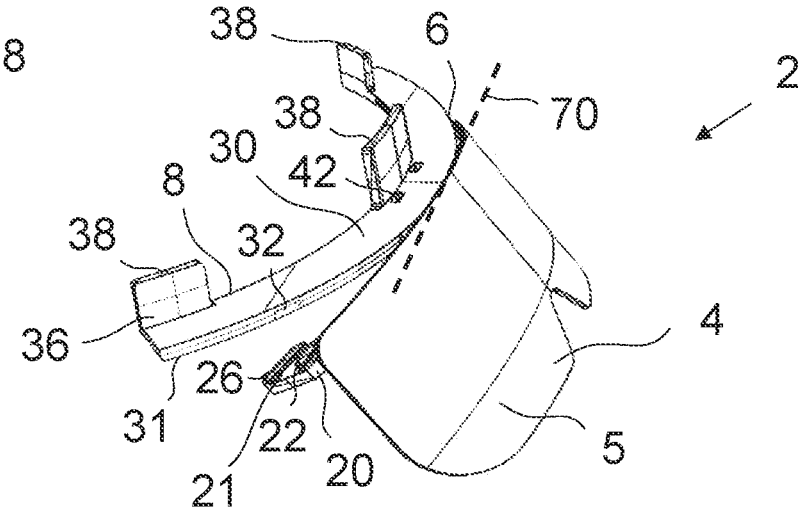
FIG. 8 illustrates a schematically simplified perspective representation of the eye protection device from FIG. 7 in the second semi-fixed state.
Figure 9:
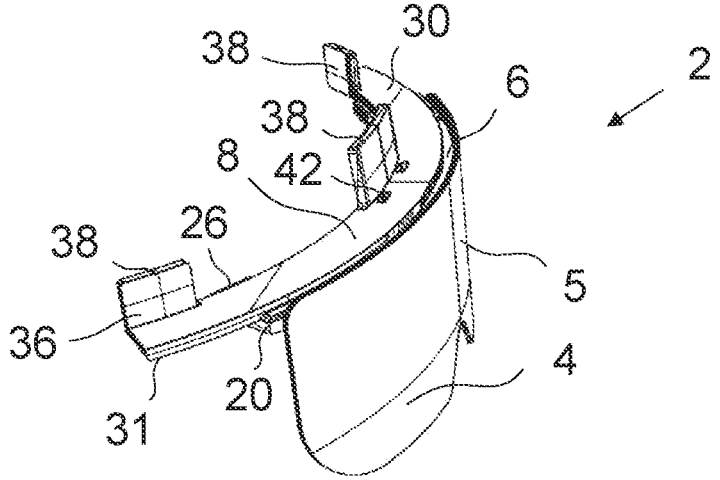
FIG. 9 illustrates a schematically simplified perspective representation of the eye protection device from FIGS. 7 and 8 in the completely fixed state.

FIGS. 7 to 9 show, in a schematically simplified and perspective manner, a second embodiment of the eye protection device 2. As depicted in FIG. 7, as well as the frame magnets 22, 23, the frame 6 in addition comprises a centrally arranged first prefixing magnet 29. The frame magnets 22, 23 are, in addition, integrated into separate portions of the contact body 20, which comprise separate first contact surfaces 21 and, in each case, a latch element 26 protruding vertically upward. A second prefixing magnet 39 is centrally integrated into the rail 30 of the fastening device 8, which is merely indicated as dashed lines on the basis of the representation. To the side of the second prefixing magnet 39, two walls project downward from the rail 30. The walls enclose a gap which is formed in a form fitted manner or in a complementary shape to a portion of the frame 6, into which the first prefixing magnet 29 is integrated. The second embodiment does not have protrusions 24 or recesses 34 similarly to the first embodiment.

FIG. 8 shows the second embodiment of the eye protection device 2 in a second prefixed state. In this second prefixed state, the first prefixing magnet 29 is prefixed to the second prefixing magnet 39 in such a way that they magnetically attract one another and the eye protection 4 is held on the fastening device 8. The downwardly protruding gap on the rail 30 prevents lateral displacement of the frame 6 with respect to the rail 30. However, a latching mechanism, comprising holding teeth 40 and assigned recesses 42 (only one of which is in each case provided with a reference numeral for reasons of clarity), prevents the frame 6 from being transferred from the depicted tilted state into the vertical state depicted in FIG. 9 by the pull of the prefixing magnets 29, 39. In the depicted second semi-fixed state of the eye protection device 2, the frame magnets 22, 23 consequently do not magnetically couple with the holding magnets 32, 33. Due to the latching mechanism, the eye protection 4 can be tilted about a horizontal swiveling axis 70. This makes it possible to either flip the viewing area 5 either completely upward, so that the user has a clear view, or to flip the viewing area 5 downward and to transfer it into the completely fixed state of the eye protection device 2 shown in FIG. 9, so that the viewing area 5 is positioned in front of the user's eyes.

As depicted in FIG. 9, in the completely fixed state, not only do the prefixing magnets 29, 39 magnetically couple with one another, but also the frame magnets 22, 23 couple with the corresponding holding magnets 32, 33. The latch elements 26, which lie in contact with a rear edge of the rail 30, prevent the eye protection 4 from being extracted horizontally from the fastening device 8 and therefore secure the eye protection 4 on the headgear 1.

The first prefixing magnet 29 can, in addition, be utilized in order to fasten the eye protection 4 to a retainer when the eye protection 4 is not needed. The retainer 4 is, for example, fastened to a garment, by way of example a vest of the user, and comprises, for example, a retaining magnet. Alternatively, in the first embodiment or the second embodiment of the eye protection device 2, a separate additional magnet, which is not shown, with which the frame 6 is magnetically fixed to the retainer, can also be provided.

While there has been shown and described what is considered to be embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

LIST OF REFERENCE NUMERALS

1 Headgear
2 Eye protection device
4 Eye protection
5 Viewing area
6 Frame
8 Fastening device
9 Underside
10 Goggles
11 Visor
12 Face shield
20 Contact body
21 First contact surface
22,23 Frame magnet
24 Protrusion
26 Latch element
29 First prefixing magnet
30 Rail
31 Second contact surface
32, 33 Holding magnet
34 Recess
36 Fixing portion
38 Holding surface
39 Second prefixing magnet
40 Holding tooth
42 Recess
50 Helmet shell
52 Seal
54 Ventilation slit
56 Neck protection
58 Air supply device
60 Vertical swiveling axis
70 Horizontal swiveling axis

What is claimed is:

1. An eye protection device comprising:

a viewing material having a viewing surface configured for viewing through the viewing surface in a viewing direction; and a frame connected to the viewing material, wherein the frame comprises at least one contact body projecting from the frame, the at least one contact body having at least one contact surface, the at least one contact surface being configured to project from the frame at an angle of 30° to 150° relative to the viewing surface of the viewing material, wherein the at least one contact body comprises at least one frame magnet integrated into the at least one contact body and configured to magnetically couple with a headgear;

wherein the frame comprises at least one protrusion plate extending from the viewing surface in a fixed direction opposite to the viewing direction, and in a coupled state of the frame to the headgear, the at least one protrusion plate is configured to be arranged in a recess of a fastening device of the headgear such that the at least one protrusion plate is inserted into the recess in the direction opposite to the viewing direction;

wherein an entirety of the at least one protrusion plate is arranged offset from the at least one contact body in a direction perpendicular to the viewing direction.

2. The eye protection device according to claim 1, wherein the at least one protrusion plate comprises first and second protrusion plates.

3. The eye protection device according to claim 1, wherein the viewing material is configured as a complete face shield configured to cover the eyes, nose and mouth of a user.

4. The eye protection device according to claim 3, further comprising an air supply device for supplying fresh air to an internal space defined between a user's face and the viewing material.

5. The eye protection device according to claim 1, wherein the viewing material comprises at least one ventilation slit on an upper side of the viewing material.

6. The eye protection device according to claim 5, wherein the viewing material is configured as goggles.

7. The eye protection device according to claim 1, further comprising a seal for sealing an internal space defined between a user's face and the viewing material.

8. The eye protection device according to claim 7, wherein the seal comprises one of a sealing foam and a sealing lip.

9. A headgear comprising:

the eye protection device according to claim 1; and a headgear body having the fastening device comprising at least one fixing portion for fixing the fastening device to an underside of the headgear body or integrally configured with the headgear body on the underside of the headgear body, wherein the at least one contact surface comprising a first contact surface;

the fastening device comprises at least one holding magnet, the first contact surface being configured in a form fitted manner or with a complementary shape to a second contact surface of the fastening device, in a completely fixed state of the eye protection device to the headgear body, the first contact surface contacts with the second contact surface and the at least one holding magnet magnetically couples with the at least one frame magnet to magnetically fix the frame to the fastening device.

10. The headgear according to claim 9, wherein:

the at least one frame magnet comprises a first frame magnet and a second frame magnet, the at least one holding magnet comprises a first holding magnet and a second holding magnet, and in the completely fixed state, the first holding magnet magnetically couples with the first frame magnet and the second holding magnet magnetically couples with the second frame magnet to magnetically fix the frame to the fastening device.

11. The headgear according to claim 10, wherein a polarity of the first frame magnet is inverse to a polarity of the second frame magnet and a polarity of the first holding magnet is inverse to a polarity of the second holding magnet.

12. The headgear according to claim 10, wherein the frame is fixed to the fastening device in a first semi-fixed state where only the first holding magnet is magnetically coupled with the first frame magnet or only the second holding magnet is magnetically coupled with the second frame magnet, wherein the frame can be pivoted, in the first semi-fixed state, about a vertical swiveling axis which runs through the magnets magnetically coupling with one another.

13. The headgear according to claim 9, wherein the frame is fixed to the fastening device in a second semi-fixed state where a first prefixing magnet arranged in a horizontal direction centrally on the frame magnetically prefixes a second prefixing magnet arranged in the horizontal direction centrally on the fastening device, wherein in the second semi-fixed state, the first contact surface is pivoted with respect to the second contact surface about a horizontal swiveling axis and the at least one frame magnet does not magnetically couple with the at least one holding magnet.

14. The headgear according to claim 9, wherein the fastening device comprises a rail extending in a horizontal direction, wherein the at least one holding magnet is integrated into the rail and the second contact surface is a portion of the rail.

15. The headgear according to claim 14, wherein the rail has a curved configuration, and a curvature of the rail is configured to correspond to a curvature of the underside of the headgear body.

16. The headgear according to claim 9, wherein the at least one fixing portion comprises at least one holding surface projecting vertically from the fastening device, which is configured to lie in contact with an inside of the headgear body.

17. The headgear according to claim 9, wherein the at least one protrusion plate is configured in a form fitted manner or with a complementary shape to the recess.

18. The headgear according to claim 9, wherein the frame comprises a latch protruding vertically from the first contact surface, the latch being configured to lie in contact with a rear wall of the fastening device in the completely fixed state.

19. The eye protection device according to claim 1, wherein the fastening device comprising:

at least one fixing portion for fixing the fastening device to an underside of the headgear body, and at least one holding magnet, the first contact surface being configured in a form fitted manner or with a complementary shape to a second contact surface of the fastening device, and wherein, in a completely fixed state of the eye protection device to the headgear body, the first contact surface contacts with the second contact surface and the at least one holding magnet magnetically couples with the at least one frame magnet to magnetically fix the frame to the fastening device.

20. The eye protection device according to claim 19, wherein:

the at least one frame magnet comprises a first frame magnet and a second frame magnet, the at least one holding magnet comprises a first holding magnet and a second holding magnet, and in the completely fixed state, the first holding magnet magnetically couples with the first frame magnet and the second holding magnet magnetically couples with the second frame magnet to magnetically fix the frame to the fastening device.

* * * * *